United States Patent [19]

Henderson et al.

[11] 4,141,455

[45] Feb. 27, 1979

[54] MEANS FOR STORING AND CONNECTING JIB ON TELESCOPIC CRANE BOOM

[75] Inventors: Francis A. Henderson, Cedar Rapids; Roger M. Wolfe, Toddville, both of Iowa

[73] Assignee: Harnischfeger Corporation, Milwaukee, Wis.

[21] Appl. No.: 815,561

[22] Filed: Jul. 14, 1977

[51] Int. Cl.[2] ..... B66C 23/06

[52] U.S. Cl. ..... 212/55; 212/144

[58] Field of Search ..... 52/114; 212/55, 144

[56] References Cited

U.S. PATENT DOCUMENTS

| | | | |
|---|---|---|---|
| 3,366,250 | 1/1968 | Grove | 212/55 |
| 3,368,838 | 2/1968 | Reich | 294/81 SF |
| 3,430,778 | 3/1969 | Brown | 212/144 |
| 3,785,505 | 1/1974 | Keller, Jr. | 212/55 |
| 3,831,771 | 8/1974 | Wiencek | 212/144 |

*Primary Examiner*—Lawrence J. Oresky
*Attorney, Agent, or Firm*—James E. Nilles

[57] ABSTRACT

A multi-section telescopic boom of a mobile crane and a jib for use therewith are provided with jib storage means to enable storage of the jib alongside the boom, with the jib base end adjacent the boom head, and are further provided with manually operable self-storing releasable pinning means for connecting the jib base end to the boom head so that the jib can be swung horizontally between a stored position and an installed position and secured in the installed position.

The jib storage means comprise adjustable forward and rear jib storage assemblies, each including storage pins and pin-receiving lugs, and axial movement of the jib effects engagement or disengagement of the storage pins and lugs.

The manually operable releasable means comprises a pair of vertically spaced apart pin-receiving members on opposite lateral sides of the boom head, and further comprises a crank-operated pin assembly on each lateral side of the jib base end. Each pin assembly comprises a vertical tubular housing having pins threaded into its ends which extend and retract when the tubular housing is rotated by means of a crank which extends through a bore in one of the pins and engages the housing. Releasable locking means prevent undesired rotation of the housing.

18 Claims, 13 Drawing Figures

MEANS FOR STORING AND CONNECTING JIB ON TELESCOPIC CRANE BOOM

BACKGROUND OF THE INVENTION

1. Field of Use

This invention relates generally to means for storing and connecting a jib on a multisection telescopic boom of a mobile crane. In particular, it relates to adjustable jib storage means to enable storage of the jib alongside the boom and to manually operable self-storing releasable pinning means for connecting the jib to the head of the boom.

2. Description of the Prior Art

Some mobile cranes have a multisection telescopic boom and a jib attachable to the point end of the boom to extend the working length of the boom. In some cranes, the jib is permanently connected to the boom head and is swingable into and out of working position as required. In other cranes, the jib is completely detachable and is stored alongside the boom base section on some types of jib storage means but can be readied for use by pivotally connecting one side of the jib base end to one side of the boom head, whereupon the jib can be swung into alignment with the boom and secured thereto. In some prior art arrangements, detachable pins or bolts are used to connect the jib to the boom head for pivoting purposes and for securing the boom extension in its in-use position. In other arrangements, the pins are part of a pin assembly and can be extended and retracted, as required, by means of a crank. U.S. Pat. No. 3,945,333 illustrates one prior art arrangement.

SUMMARY OF THE INVENTION

A multisection telescopic boom of a mobile crane and a jib for use therewith are provided with jib storage means to enable storage of the jib alongside the boom, with the jib base end adjacent the boom head, and are further provided with manually operable releasable pinning means for connecting the jib base end to the boom head so that the jib can be swung horizontally between a stored position and an installed position and secured in the installed position.

The jib storage means comprise adjustable forward and rear jib storage assemblies. The forward jib storage assembly includes storage pins on the side of the boom base section for engagement with pin-receiving lugs on the jib. The rear jib storage assembly includes a storage pin on the jib for engagement with a pin-receiving lug on the side of the boom base section. Axial movement of the jib relative to the boom base section, while one side of the jib base end is pinned to one side of the boom head and while the jib is alongside the boom, effects engagement or disengagement of the storage pins and lugs.

The manually operable releasable pinning means comprises a pair of vertically spaced apart pin-receiving members on opposite lateral sides of the boom head, each member having a pin-receiving hole therein, and further comprises a crank-operated pin assembly on each lateral side of the jib base end.

Each pin assembly comprises a vertically disposed rotatable tubular housing which is mounted on one side of the jib base end and is adapted to fit between the spaced apart pair of pin-receiving members on a side of the boom head. The housing is provided with upper and lower foot pins at its upper and lower ends, respectively, which foot pins are extendable and retractable with respect to the housing as the housing is rotated. Each foot pin has an externally threaded inner end portion which is received in threaded engagement with an internally threaded portion inside the housing. A disc drive plate having a non-circular central opening is rigidly mounted to and within the housing between the upper and lower foot pins. One of the foot pins, preferably the lower one, is hollow and accommodates a disc drive crank which extends therethrough and engages the hole in the disc drive plate. Rotation of the crank effects rotation of the housing and extension or retraction of the upper and lower foot pins.

A releasable latch assembly is mounted on the exterior of the housing of each pin assembly and is releasably engageable with a portion of the jib to prevent housing rotation when the jib is mounted in the in-use position.

In operation, one of the pin assemblies is operated to connect the jib to the boom head while the jib is in storage position to enable the jib to be axially advanced so as to disengage it from the storage means and then swung between the storage and in-use positions, whereupon the other pin assembly is operated to secure the jib to the boom head.

The manually operable self-storing releasable pinning means and the jib storage support means in accordance with the invention offer several advantages over the prior art arrangement. For example, the storage means enable the jib to be pivotally connected to or disconnected from the boom while the jib is in the stored position and this can be done by a single person. The jib storage means which comprise a forward jib storage assembly and a rear jib storage assembly are constructed so that the jib storage pins are automatically in alignment with the holes in the lugs which receive the pins. In addition, the jib storage pins are mounted so that they can be adjusted for proper alignment. Also, the rear jib storage assembly includes ramp means whereby the rear jib storage pin and its associated components are guided upwardly into proper alignment with the associated lug thereby taking into account the tendency of the point end of the jib to sag downwardly because of the weight of the jib. Furthermore, the releasable pinning means allow for complete disconnection between the boom and the jib so that the boom can be used independently of the jib in the conventional manner. Also, the releasable pinning means allow for insertion and removal of the pins (extension and retraction) by means of a crank and eliminate the need for the human operator to try to force-fit pins or bolts by means of hammers, wrenches, or other tools. Also, since the pins of the present pinning means are not detached from the assembly but are an integral part thereof, there is no danger of losing any pins. It is important also that in the present arrangement the externally threaded inner end portions of the pins are always enclosed and protected within the tubular housing with which they are associated and within which they are stored. Thus, there is no danger of the threads being damaged and thereby rendering the pinning means inoperative as is the case in prior art arrangements wherein threads are exposed to the elements and to the possibility of mechanical damage. In this regard, the housing assists in retaining grease which is applied to the threaded portions of the pins. Other objects and advantages of the invention will hereinafter appear.

DESCRIPTION OF A PREFERRED EMBODIMENT

General Arrangement

Figure 1:
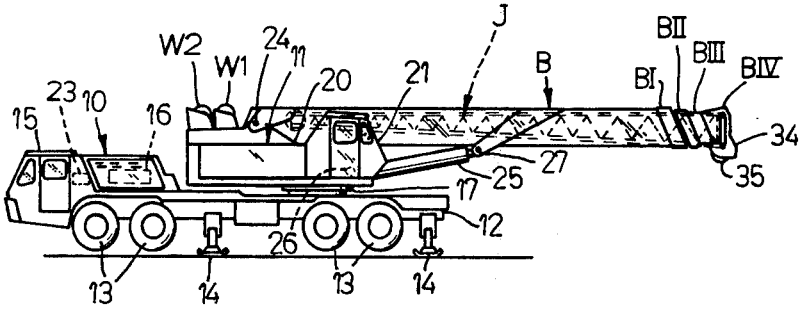
FIG. 1 is a side elevational view of a mobile crane having a multisection telescopic main boom, an optionally useable jib stored alongside the main boom, and releasable pinning means and jib storage support means in accordance with the invention.
Figure 2:
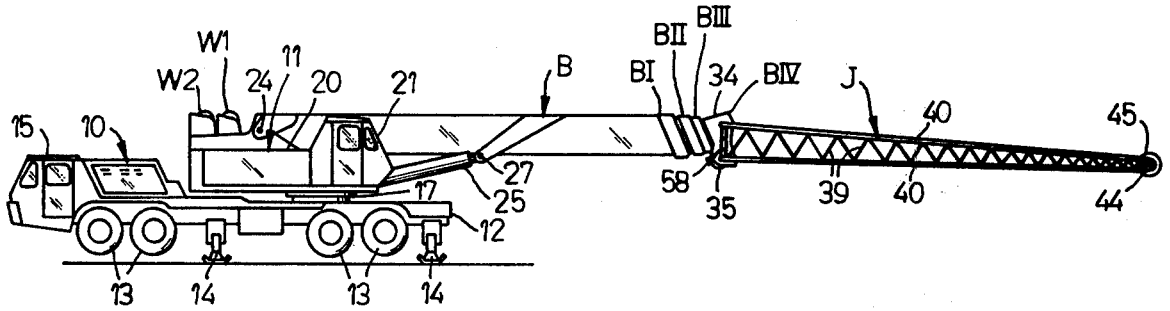
FIG. 2 is a view similar to FIG. 1 but showing the jib connected to the main boom in its in-use position.

Referring to FIGS. 1 and 2, there is shown apparatus such as a mobile crane in accordance with the invention and which comprises a lower unit 10 in the form of a vehicle such as a truck and an upper unit 11 which is mounted for horizontal rotation in either direction on the lower unit by means of a conventional turret 17. Truck 10 comprises a chassis 12 on which are mounted ground wheels 13, extendable outriggers 14, a driver's cab 15 and an internal combustion engine 16 behind the cab for driving the ground wheels. Upper unit 11 comprises a supporting framework 20 on which are mounted a telescopic boom B, main and auxiliary winches W2 and W1, respectively, on which load hoist lines are wrapped, and a crane operator's cab 21. The internal combustion engine 16 also drives a hydraulic pump 23 located in the lower unit 10 which supplies operating fluid for the winches W1 and W2 and for hydraulic cylinders located in the upper unit and hereinafter described.

Boom B, which is shown in a generally horizontal telescoped and stored position lengthwise of truck 10, comprises four hollow boom sections, namely: a base section BI, an inner midsection BII, an outer midsection BIII, and a fly section BIV. In an actual embodiment, for example, boom B is fully extendable to about 114 feet. Boom base section BI is pivotally connected to framework 20 of upper unit 11 by pin means 24. Extendable and retractable hydraulic boom hoist cylinders 25 are provided to raise and lower boom B and each is pivotally connected to and between framework 20 and boom base section BI by pin means 26 and 27, respectively. Fly section BIV is provided with a working head 34 at the boom point on which a sheave 35 for a load hoist line is rotatably mounted.

Extendable and retractable hydraulic boom extension cylinders (not shown) are located within boom B and are connected to boom sections BII, BIII and BIV, respectively, to effect axial extension and retraction of the latter. Control means (not shown) are understood to be provided to operate the cylinders either individually or in unison, depending upon the crane operator's choice.

Figure 4:
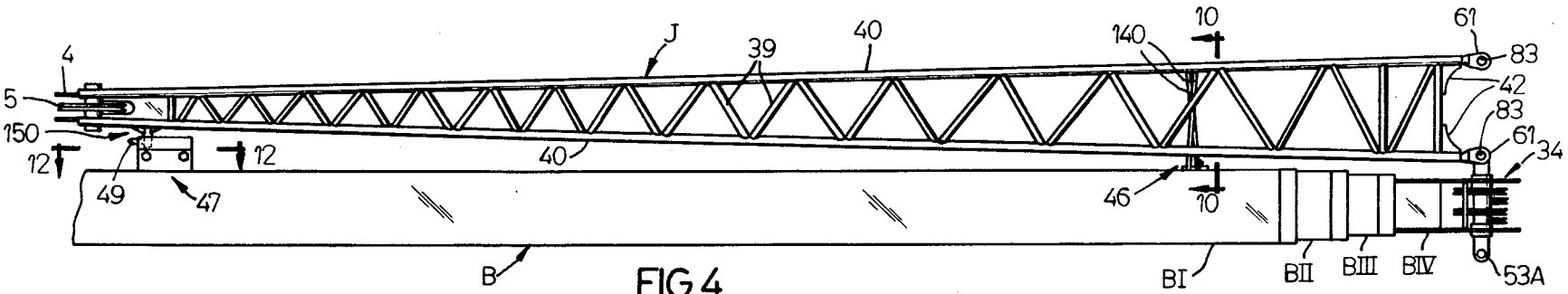
FIG. 4 is an enlarged top plan view of the main boom and the jib, showing the jib in its stored position.

As FIGS. 1 and 4 show, the mobile crane has an optionally useable lattice-type jib J storable alongside boom B, with the base end of the jib adjacent the point end of the boom. Jib J comprises a hollow lattice-type jib section about 33 feet long and comprises four longitudinal members 40 interconnected by cross-braces 39 and by gussets 41 and 42 at its base end. Jib J is provided with a working head 44 at the jib point on which a sheave 45 for load hoist line is rotatably mounted. When jib J is stored, as shown in FIGS. 1 and 4, it is reversely disposed with respect to boom B, i.e., its foot end is adjacent, near or toward the point of boom B and its point end is adjacent, near or toward the base of foot end of boom B. Jib J is stored alongside the base section of the crane boom by means of a pair of longitudinally spaced apart jib storage support assemblies 46 and 47 mounted on the boom base section BI and on the jib J. The jib storage support assemblies 46 and 47 comprise storage pins 48 and 49, respectively. The pins 48 are mounted on an exterior side of the boom base section BI for engagement with holes **50*a* in jib support lugs 50 provided on the jib J. The pin 49 is mounted on the exterior side of jib J for engagement with a hole 152 in a support lug 51 on boom base section BI, as hereinafter explained in connection with FIGS. 10–13. Axial movement of the jib J effects engagement and disengagement of the storage pins 48, 49 and jib support lugs 50, 51**, respectively, when the jib is reversely disposed alongside the boom base section BI.

Manually operable self-storing releasable pinning means are provided for releasably connecting the jib J to the boom head 34 whereby the jib can be swung around from storage position substantially parallel to the boom B to an in-use position in alignment with the boom and for locking the jib in the in-use position. The pinning means comprises a pair of vertically aligned and spaced apart pin-receiving members 53, 54 and 53A, 54A on each lateral side of the boom head 34 and each pin-receiving member has a pin-receiving hole 55 therein. The pinning means also comprises a pair of pin assemblies 57, 58 mounted on opposite lateral sides of the base end of the jib J for releasably connecting the jib to the boom head 34. In operation, the one pin assembly 57 is operated to connect the jib J to one pair of pin-receiving members 53, 54 on one side of the boom head 34 while the jib is in storage position to enable the jib to be swung between the storage and in-use positions, whereupon the other pin assembly 58 is operated to secure the jib to the other pair of pin-receiving members 53A, 54A on the other side of the boom head.

Each pin assembly 57, 58 comprises a vertically disposed rotatable tubular housing 60 which is rotatably mounted between a pair of upper and lower clevises 61 and 62 on a side of the jib base end. The housing 60 is provided with an upper foot pin 63 and lower foot pin 64 at its upper and lower ends, respectively, which foot pins are extendable and retractable with respect to the housing as the housing is rotated. Each foot pin 63, 64 has an externally threaded inner end portion 65 which is received in threaded engagement with an internally threaded portion 66 inside the housing. A disc drive plate 67 having a non-circular central opening or hole 68 is rigidly mounted to and within the housing 60 between the upper and lower foot pins 63, 64. One of the foot pins, preferably the lower one 64, is hollow and has a bore 70 which accommodates a disc drive crank 71 which extends therethrough and engages the hole 68 in the disc drive plate 67. Rotation of the crank 71 effects rotation of the housing 60 and extension or retraction of the upper and lower foot pins 63, 64.

A releasable latch assembly 73 is mounted on the exterior of the housing 60 of each pin assembly 57 and 58 and is releasably engagable with a gusset 41 on the jib J to prevent housing rotation when the jib is mounted in the in-use position.

Boom Head and Pin-Receiving Members

Figure 3:
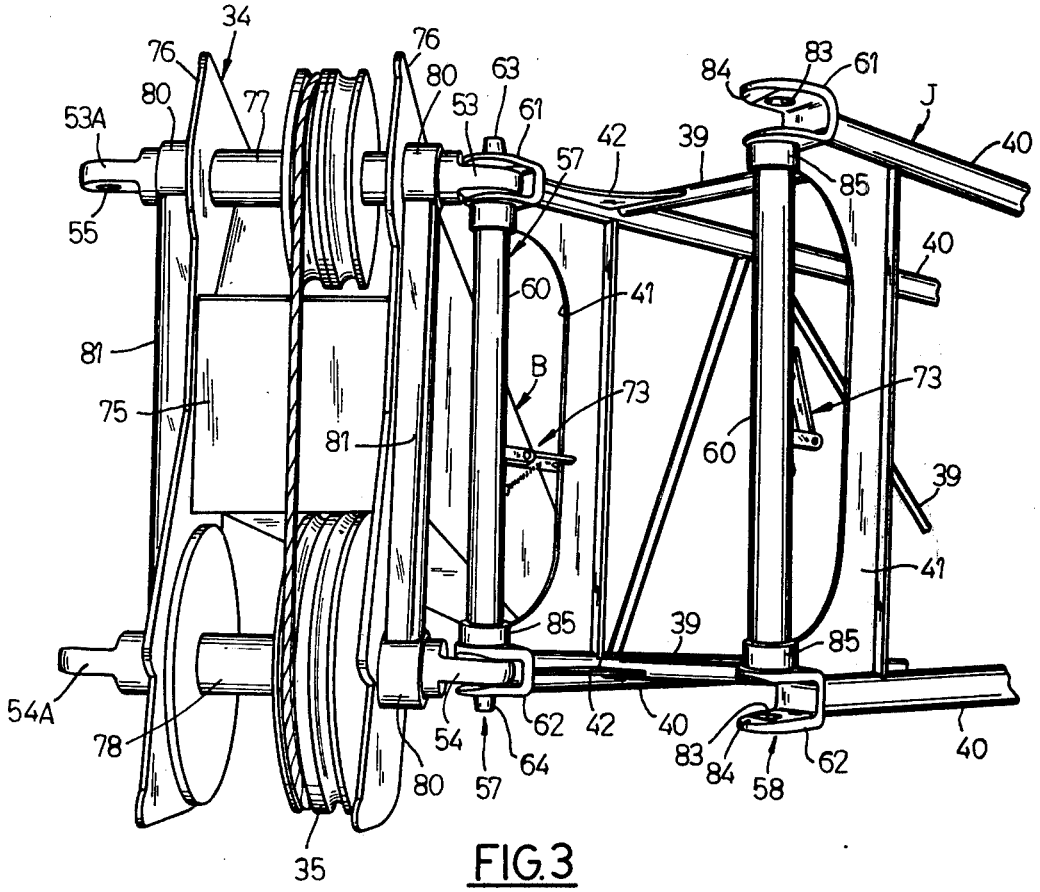
FIG. 3 is an enlarged perspective view of the boom head of the main boom and the base end of the jib and further showing one side of the base end of the jib pivotally secured to one side of the boom head by a portion of the pinning means so as to enable the jib to be swung between storage and in-use positions.
Figure 5:
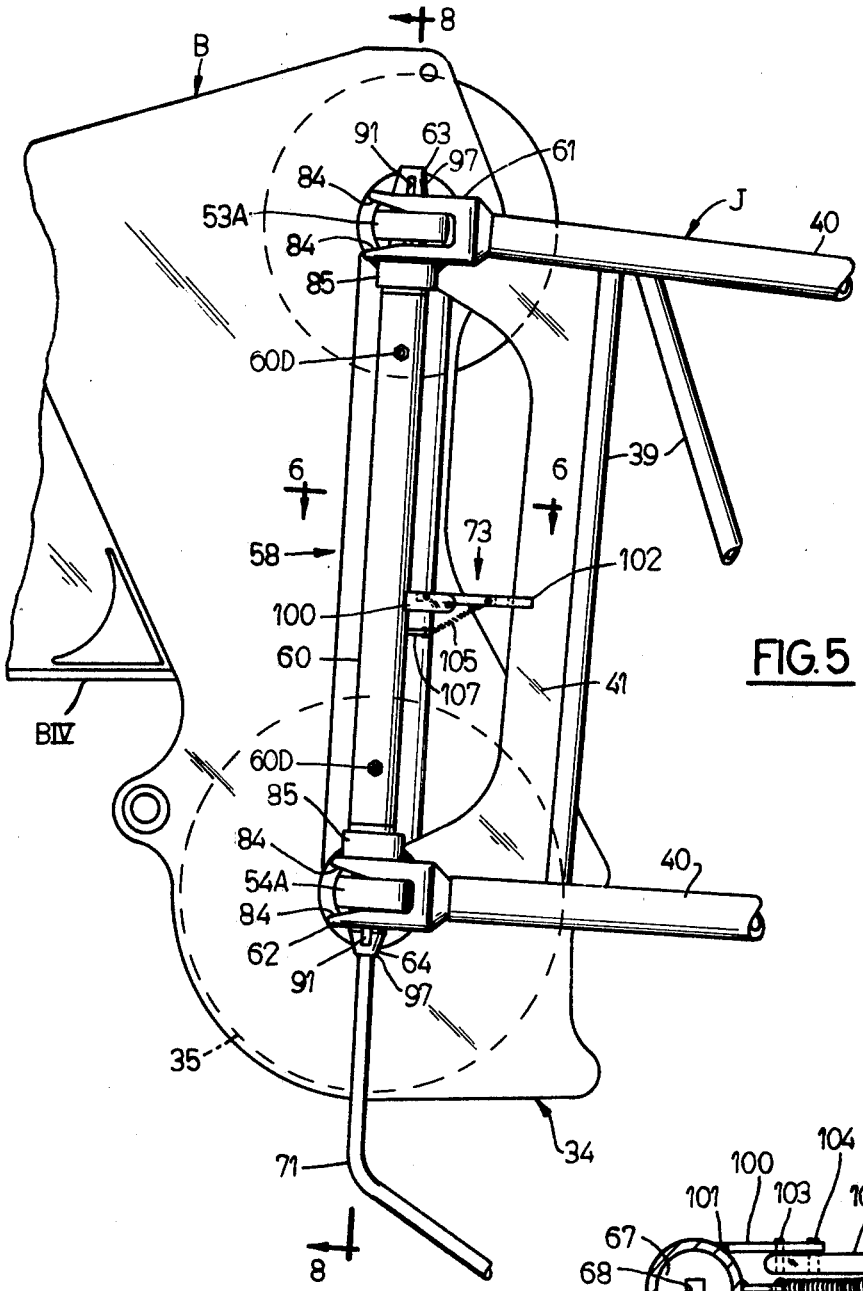
FIG. 5 is an enlarged side elevational view showing the boom head and the base end of the jib attached thereto by pinning means in accordance with the invention.
Figure 6:
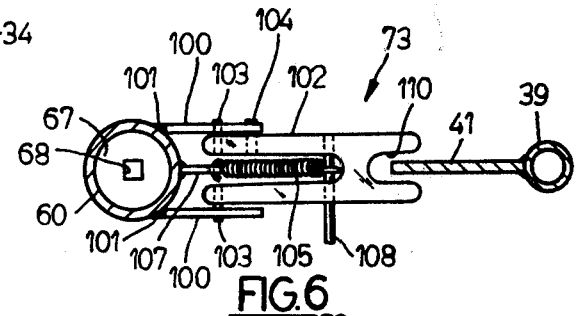
FIG. 6 is an enlarged top plan view of releasable locking means for the pinning means and taken on line 6—6 of FIG. 5.
Figure 7:
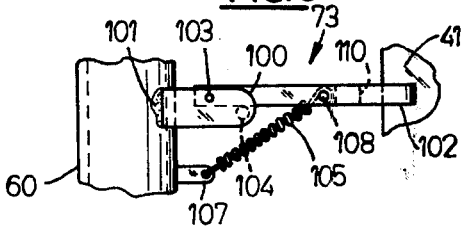
FIG. 7 is a side elevation view of the locking means shown in FIG. 6.

As FIGS. 3 and 5 best show, the boom head 34 of boom B comprises a cross plate 75 which is rigidly secured as by welding to the outermost forward end of the boom fly section BIV and two laterally spaced apart side plates 76 which are rigidly secured as by welding on opposite sides of the cross plate 75. The side plates 76 support upper and lower cylindrical rods or pins 77 and 78, respectively, which extend through the side plates 76 and are rigidly secured thereto as by welding. The ends of the rods 77 and 78 extend outwardly for a short distance beyond the side plates 76 and are shaped so as to provide the pin-receiving members 53A, 53 and 54A, 54. Each pin-receiving member is flattened at that portion whereat the pin-receiving hole 55 extends therethrough so as to enable the pin-receiving member to be receivable within its associated clevis 61 or 62 on the base end of the jib J. The pin-receiving members 53 and 54 comprise a first pair of vertically spaced apart pin-receiving members on one side of head 34 and the pin-receiving members 53A and 54A comprise a second pair on the other side of the head. The holes 55 in each pair are vertically aligned or in registry with each other. As FIG. 3 shows, head 34 is further strengthened by collars 80 which are welded on the outer sides of the plates 76 and through which the pins 77 and 78 extend. A base 81 is disposed between each pair of upper and lower collars 80 and is welded thereto and to its associated side plate 76.

Jib Base End and Pin Assemblies

As FIGS. 3 and 5 best show, jib J is of lattice-type construction and comprises four tubular longitudinal members 40 which are interconnected by tubular welded-in-place cross members 39. At its base end, jib J is further reinforced and rigidified by the pair of vertically extending gussets 41, each of which is welded between an upper and lower longitudinal member 40, and by four horizontally disposed gussets 42, each of which is welded between a longitudinal member 40 and the last horizontal cross brace 39 of the jib J. At its base end, jib J is provided with four clevises such as the two upper clevises 61 and the two lower clevises 62. Each clevis is welded to the end of a longitudinal member 40 and to the gusset plates 41 and 42. Each leg of a gusset 61, 62 is provided with a hole 83 for accommodating passage of the associated foot pin 63, 64. Preferably, each leg of a clevis 61, 62 is chamferred as at 84 to facilitate engagement of the clevis with an associated pin-receiving member.

As FIGS. 3, 5, 8, and 9 show, the underside of each upper clevis 61 and the upper side of each lower clevis 62 is provided with a collar 85 which has a pin-receiving opening 86 therethrough. Each collar is secured to its associated clevis as by welding at 87 around the periphery thereof. Each collar 85 is provided with a threaded opening 88 for receiving a threaded set screw 89 which has a lock nut 90 thereon. The set screw 89 extends into an axially extending slot or groove 91 on the exterior surface of the associated foot pin 63, 64 to prevent relative rotation of the foot pin during operation of the pin assembly as hereinafter explained.

Figure 8:
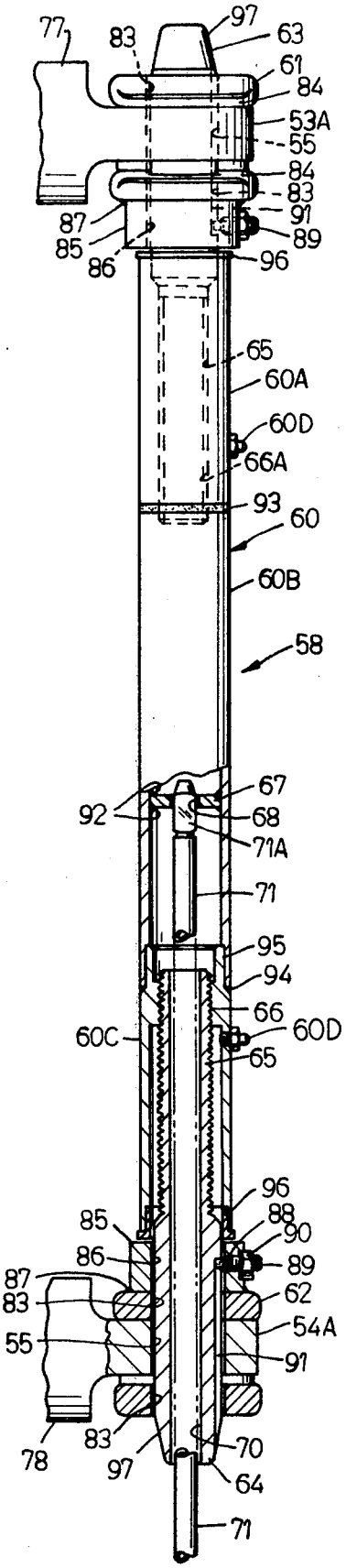
FIG. 8 is an enlarged view partly in cross section of the pinning means, taken on line 8—8 of FIG. 5, and showing the pins extended.
Figure 9:
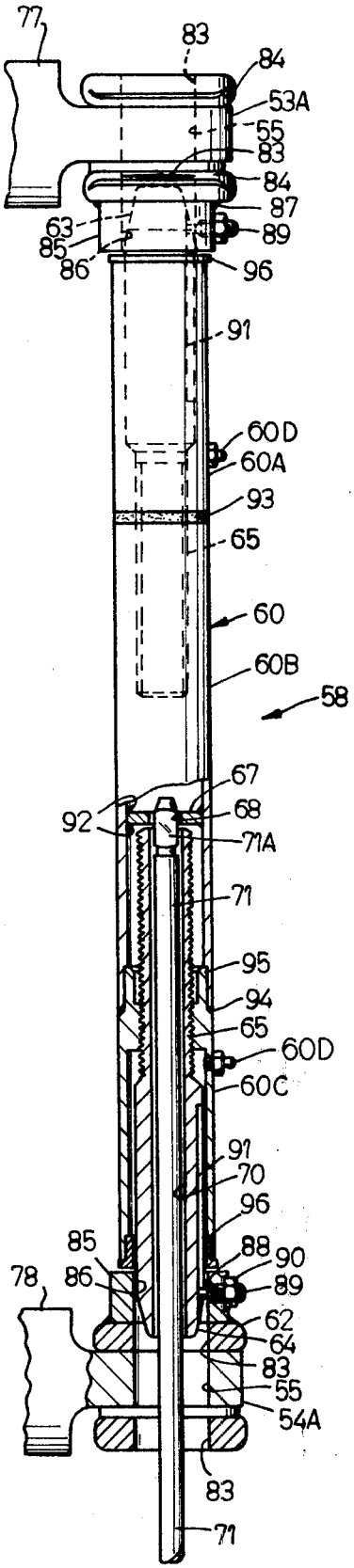
FIG. 9 is a view similar to FIG. 8 but showing the pins retracted.

Referring to FIGS. 8 and 9, it is seen that the pin assembly 58, which is understood to be identical in construction and mode of operation to pin assembly 57, comprises a tubular housing 60 which extends between but does not engage the upper and lower collars 85 on the upper and lower clevises 61 and 62. To simplify fabrication, housing 60 is preferably fabricated of three component parts or sections designated as upper section 60A, mid section 60B, and lower section 60C. The disc drive plate 67 is located within mid section 60B and is secured thereto as by welding at 92. Preferably, section 60B is cylindrical and the disc drive plate 67 is circular but the hole 68 in the disc drive plate may take any non-circular form so as to enable it to engage a correspondingly shaped end portion 71A of crank 71. For example, each portion 71A of crank 71 is of square cross-sectional configuration, the hole 68 is square. Mid section 60B of housing 60 is secured as by welding to the upper section 60A and the lower section 60C at 93 and 94, respectively. More specifically, section 60C is tubular in form and is provided with a shoulder 95 which facilitates its insertion in mid section 60B and is provided with the internally threaded portion 66 for engagement with the foot pin 64. Lower section 60C is provided with a bushing 96 at its lower end to reduce frictional wear at the lower end of the tubular housing 60. It is to be understood that upper section 60A is similar in construction to lower section 60C. However, the threads on threaded portion 66 of lower section 60C are reversed with respect to the threads on threaded portion 66A of upper section 60A of tubular housing 60. Similarly, the threads on the threaded inner end portion 65 of the upper foot pin 63 and the lower foot pin 64 are reversed so that when tubular housing 60 is rotated in one direction by means of crank 71, the pins 63 and 64 move in opposite directions with respect to each other, i.e., both move inward of tube 60 together or move outward of tube 60 together. The foot pins 63 and 64 have tapered outermost end portions 97 which facilitate their passage through the holes 55 in the pin-receiving members 53, 53A, 54, 54A in the event that there is slight misalignment therebetween during operation. As FIGS. 8 and 9 show, the upper foot pin 63 takes the form of a solid member whereas the lower foot pin 64 is hollow and provided with the central bore 70 for accommodating the passage of the crank 71 therethrough.

If preferred, however, either or both upper and lower foot pins could have a crank-receiving bore therethrough. The upper and lower sections 60A and 60C of housing 60 are provided with grease fittings 60D through which lubricant can be injected to lubricate the threads on the foot pins and the threaded portions of the housing.

As FIGS. 3, 5, 6, and 7 show, the releasable latch assembly 73 is mounted on the exterior of the housing 60 of each pin assembly 57 and 58 and is releasably engageable with the associated gusset 41 on the jib J to prevent rotation of housing 60 when the jib is mounted in the in-use position and thereby prevent inadvertent withdrawal of the foot pins and unintentional disengagement of the jib J from the boom B. The latch assembly 73 comprises a pair of spaced apart support brackets 100 which are welded as at 101 to the housing 60 near a midpoint thereof. A latch plate 102 is pivotally connected at one end as by means of pins 103 to the mounting brackets 100 and is biased in one direction (downwardly) against a stop member 104 on the support bracket 100 by a tension-type biasing spring 105 which has one end connected to a spring attachment member 107 welded to housing 60 and has its other end connected to a spring attachment and manual release pin 108 on the plate 102. The outer end of plate 102 is provided with a notch or groove 110 for engagement with the forward edge of a gusset 41. The latch plate 102 is normally disposed in released overcenter position as shown in connection with the latch assembly 73 in FIG. 3 and the housing 60 is free for rotation by means of the crank 71. However, when the foot pins are extended as are those of pinning assembly 57 as shown in FIG. 3, it is desirable to prevent further rotation of housing 60 which might cause withdrawal of the pins. Accordingly, then, the latch plate 102 is swung downwardly to the position shown in FIGS. 3, 5, 6, and 7 wherein the notch 110 engages the gusset 41 so as to prevent intentional or unintentional rotation of housing 60 and operation of the foot pins. The latch plate 102 is swingable between its latched and unlatched positions manually as by grasping the pin 108 and swinging the plate 102. The biasing spring 105 tends to maintain the latch plate 102 in locked position after the latch plate is swung downwardly past its overcenter position.

Jib Storage Support Assemblies

FIG. 4 shows the jib storage means which includes the forward jib storage assembly 46 and the rear jib storage assembly 47 which support the jib J on boom B when the jib is not in use. The jib storage assemblies 46 and 47 employ components, hereinafter described, which are mounted on one of the outer lateral sides of the boom base section BI and the adjacent lateral side of the reversely disposed jib J. As FIG. 4 shows, the jib J is stored in such a manner that, when boom fly section is properly adjusted, the holes 83 on the innermost upper and lower clevises 61 and 62 of the jib will be in registry with the holes 55 in the upper and lower pin-receiving members 53 and 54, respectively, on the boom head 34 to facilitate connection of the jib base end to the boom head 34 by means of the pinning assembly 57. When this pinning is done, slight forward axial movement of boom section BIV relative to boom base section BI will cause corresponding forward axial movement of jib section J and will cause the pins 48 in forward jib storage assembly 46 and the pin 49 on the rear jib storage assembly 47 to disengage from the pin holes **50*a* and 152 in their associated lugs 50 and 51. In this manner, the jib J is detached from the side of boom B and thereafter can be swung about the pinning assembly 57 into alignment with boom B and then secured thereto by means of the pinning assembly 58. Conversely, rearward axial movement of jib J while it is still secured by pinning assembly 57 and reversely disposed alongside boom B will cause the pins 48 and 49 to engage the lugs 50 and 51** for jib storage.

Figure 10:
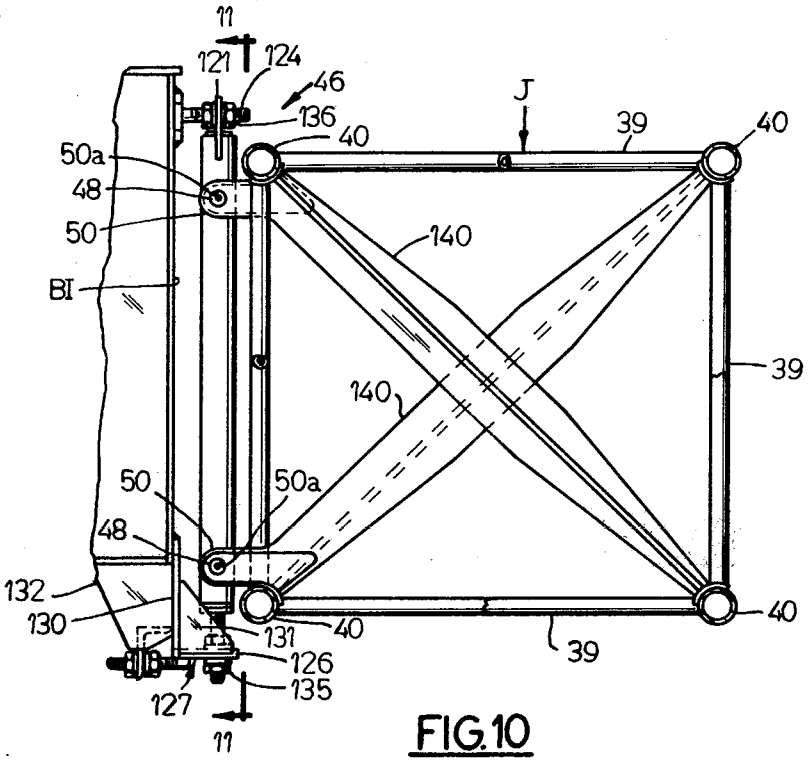
FIG. 10 is an enlarged view showing the forward jib storage support assembly and is taken on line 10—10 of FIG. 4.
Figure 11:
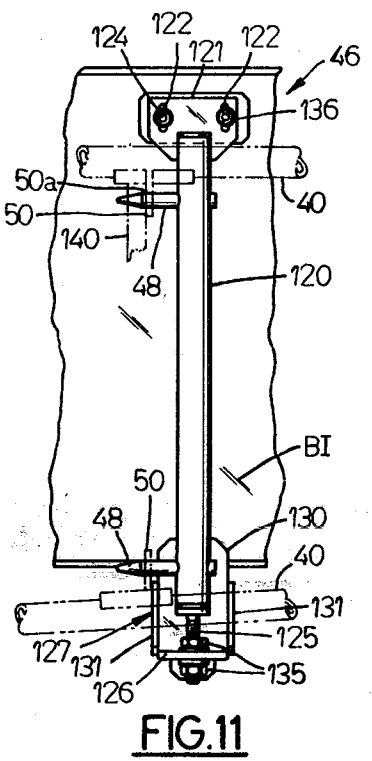
FIG. 11 is a view of the forward jib storage assembly taken on line 11—11 of FIG. 10.

As FIGS. 4, 10, and 11 show, the forward jib storage assembly 46 comprises the upper and lower forwardly projecting pins 48 which are mounted on boom base section BI by means of a support tube 120. Support tube 120 has its upper end rigidly connected to an adjustment plate 121 which has a pair of spaced apart adjustment holes 122 therein for receiving mounting bolts 124 which rigidly secure the plate to the side of boom base section BI. A threaded stud 125 is rigidly secured to the lower end of support tube 120 and extends downwardly through an opening in a base plate 126 of a lower support bracket 127 on boom base section BI. The lower support bracket 127 comprises a back plate 130, the aforementioned base plate 126, a pair of bracket side plates 131 and a supporting gusset 132 which is connected between the bottom of boom section BI and the rear of back plate 130. Support tube 120 is vertically adjustable so as to enable the upper and lower pins 48 thereon to be located in proper relationship to the lugs 50 on jib J. Thus, by loosening the nuts 135 on threaded stud 125 and by loosening the nuts 136 on the mounting bolts 124, the support tube 120 can be moved to the desired vertical position, whereupon the nuts 136 and 135 are tightened.

The pins 48 are engageable with the holes **50*a* in the upper and lower lugs 50 on jib J. As FIG. 10 shows, each lug 50 is rigidly secured as by welding to a lug support brace 140. Each lug support brace 140 extends diagonally between and is rigidly secured, as by welding, to an upper longitudinal member or chord 40 and the diagonally opposite lower longitudinal cord member 40. The lug support braces 140 also strengthen the jib J at the locations whereat it is supported on the forward jib storage assembly 46**.

Figure 13:
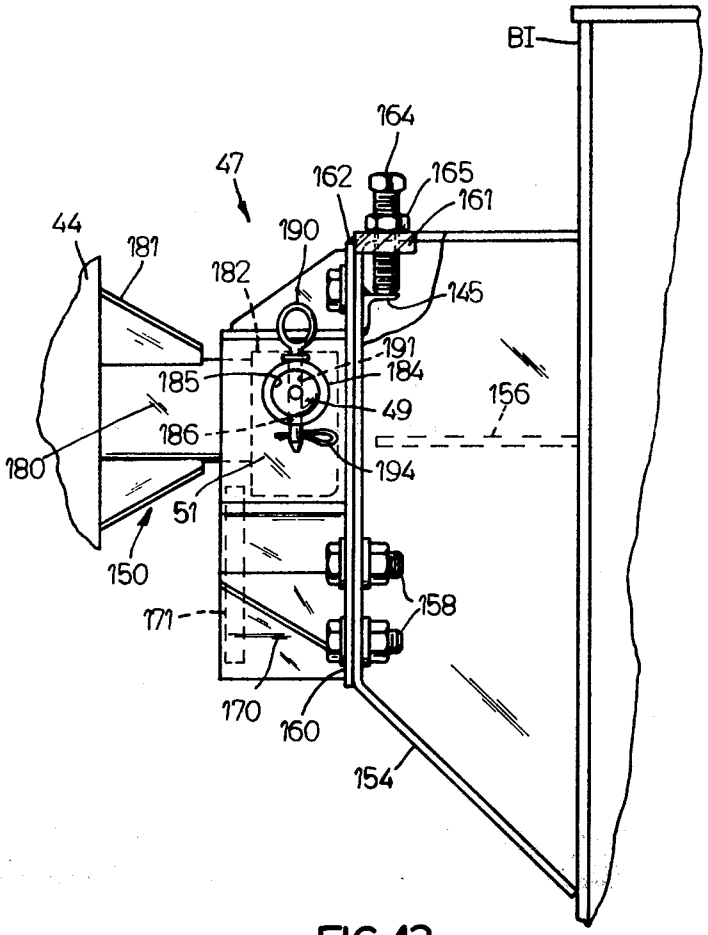
FIG. 13 is an end elevational view of the rear storage support shown in FIG. 12.
Figure 12:
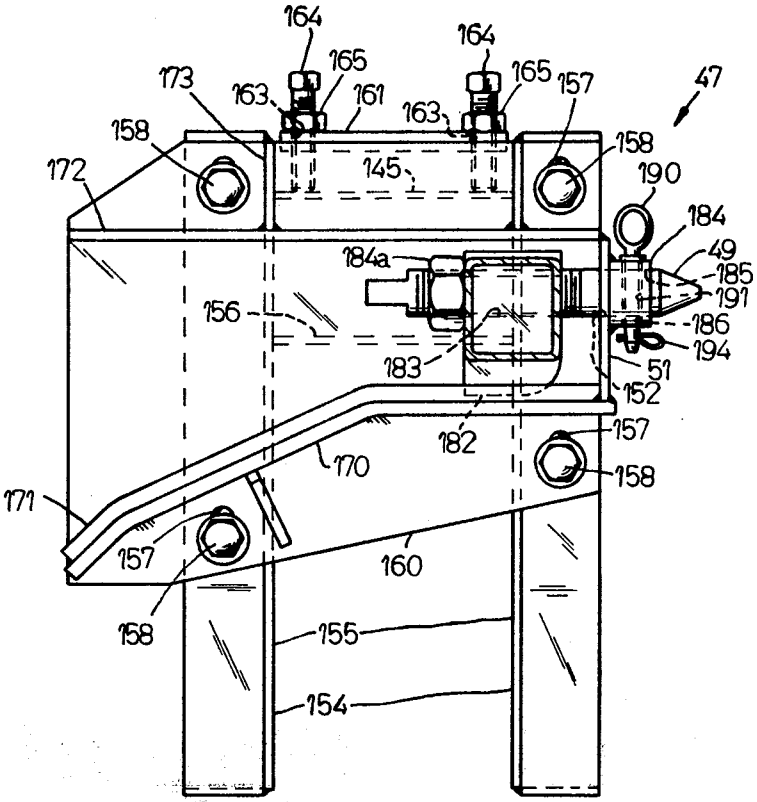
FIG. 12 is an enlarged view of the rear storage assembly taken on line 12—12 of FIG. 4.

As FIGS. 4, 12, and 13 show, the rear jib storage assembly 47 comprises the rearwardly projecting pin 49 which is mounted on the side of jib head 44 by means of a pin support assembly 150. Pin 49 engages a hole 152 in the lug 51 which is mounted on the side of boom base section BI. It is to be noted that the pins 48 on forward jib storage assembly 46 extend in the reverse direction from the pin 49 on the rear jib storage assembly 47. Furthermore, the pins 48 are mounted on boom B and the pin 49 is mounted on the jib J.

As FIGS. 12 and 13 show, the pin support assembly 150 comprises a pair of spaced apart brackets 154 which are welded to the side of boom section BI. Each bracket 154 is provided with a side plate 155 which is welded thereto and a cross-brace 156 is welded between the side plates and the side of boom section BI to provide rigidity and strength. Each of the brackets 154 is provided with a pair of vertically spaced apart elongated mounting holes 157 for receiving mounting bolts 158 which secure a face plate 160 to the brackets 154. The face plate 160 has a flange member 161 welded as at 162 to the upper edge thereof and the flange is provided with threaded openings 163 for receiving adjustment screws 164 which have lock nuts 165 thereon. The adjustment screws 164 engage a short length of angle iron 145 which is secured as by welding between the side plates 155 of the brackets 154. When the mounting bolts 158 are loosened, the face plate 160 may be adjusted upwardly or downwardly as required by means of the adjustment screws 164 which bear against the member 145. When face plate 160 is in desired position, the lock nuts 145 are tightened and the mounting bolts 158 are tightened. The face plate 160 is provided with a sloped ramp 170 which is welded to and extends outwardly from the face plate. A guide rail 171 is provided near the outer edge of the ramp 170. Face plate 160 is also provided with a flat guide plate 172 which is secured thereto as by welding and disposed above the ramp 170. Gussets 173 are welded between the face plate 160 and the guide plate 172 to strengthen and rigidify it. The face plate 160, the ramp 170, and the guide plate 172 cooperate to provide a channel or path within which the pin support assembly 150 is guided.

As hereinbefore mentioned, the pin 49 is mounted on the side of jib head 44 by means of the pin support assembly 150 which comprises a hollow rectangular shank 180 which is welded to jib head 44 and further strengthened and rigidified by welded-in-place gussets 181. A pin support block 182 is welded to the end of shank 180 and is provided with a threaded opening 183 into which the pin 49 is screwed. A lock nut 184*a* on pin 49 maintains it in desired position. The lower surface of the pin support block 182 rides on the ramp 170 between face plate 160 and guide rail 171 as the jib J is moved forwardly or rearwardly axially to disengage or engage the jib from storage position. In FIGS. 12 and 13, it is assumed that the jib J is in fully stored position and that the pin 49 on the jib is fully engaged with the hole 152 in the lug 51 which is welded to the face plate 160, the ramp 170, and the guide plate 172 at the end of the channel formed thereby. A collar or sleeve 184 is welded on the exterior side of lug 51 and has a hole 185 therethrough for receiving the pin 49. The sleeve 184 is also provided with aligned holes 186, transverse to its pin-receiving hole 185, for accommodating a lock pin 190 which extends therethrough and through a hole 191 in the pin 49. The lock pin 190 is removable and is used to lock the jib J in stored position. Lock pin 190 is provided with an opening at its lower end for receiving a cotter pin 194.

Operation

The jib storage means and releasable pinning means in accordance with the present invention are employed with boom B and jib J as follows. Initially, assume that the apparatus is in the condition shown in FIGS. 1 and 4 wherein the jib J is reversely disposed with respect to boom B, and that the jib is still in fully stored position. To disengage the jib J from the storage position, to swing it into its in-use position and to secure it therein, it is necessary to adjust boom fly section BIV with respect to the jib, as shown in FIG. 4, so that the pinning assembly 57 can be operated to engage one side of the base end of the jib J with one side of the boom head 34. In order to operate pinning assembly 57 to effect extension of the foot pins thereof, it is necessary to release the locking means 73 so that the housing 60 of pinning assembly 57 can be rotated. When this is done, the crank 71 is inserted through the foot pin 64 into engagement with the hole 68 in the crank plate 67. When this is done, manual rotation of crank 71 causes rotation of housing 60 and, since the foot pins 63 and 64 are prevented from rotation by means of their associated set screws 89, the foot pins are caused to extend from the housing 60 as the housing rotates. The foot pins move through the holes 83 in the upper and lower clevises 61 and 62 and through the holes 55 in the pin-receiving elements 53 and 54. When the pins are fully extended, the jib J is ready to be moved axially along with fly section BIV. Before this forward axial movement can occur, it is necessary to remove the cotter pin 194 from the lock pin 190 and to remove the lock pin 190 from the pin 49 in the rear jib storage assembly 47. When this is done, jib J is moved forward axially thereby causing the pin 49 to disengage from the hole 152 and lug 51. Simultaneously, the lug plates 50 in the forward jib storage assembly 46 slide off of the pins 48. After the pins are disengaged, the jib J can be swung horizontally about the pinning assembly 57, as shown in FIG. 3, to cause the clevises 61 and 62 on the jib base end to move into engagement with the pin-receiving members 53A and 54A on the boom head 34. After this is done, the pinning assembly 58 is operated to cause extension of its foot pins and thereby secure the jib J in its in-use position on boom B. Since it is desirable to prevent rotation of the housings 60 of the pinning assemblies 57 and 58 which would cause unintended retraction of the foot pins and possible disengagement of the jib J from the boom B, it is necessary to move the locking means 73 to the locked position. The boom B with the jib J attached as described above, is ready for operation as soon as the necessary rigging is accomplished.

Jib J is disconnected and stored by reversing the above-described procedures. Briefly, the locking means 73 are unlocked, the foot pins of the pinning assembly 58 are retracted, the jib J is swung horizontally alongside the boom B, fly section BIV and the attached jib J are moved axially rearwardly so as to cause the lugs 50 on the forward storage assembly to engage the storage pins 48 and so as to cause the rear storage pin 49 to engage the hole 152 in rear lug 51, whereupon the lock pin 190 and cotter pin 194 are put in place. It is to be noted that during the boom storage operation, the ramp 170 facilitates guidance of the pin 49 into alignment with the hole 152 and lug 51. Because jib J is long and heavy, the point end thereof tends to sag slightly into a position whereby pin 49 would not be in proper alignment with hole 152 as a result of horizontal swing of the jib. The ramp 170 gradually eases the point of the jib J upwardly as the jib is moved axially rearwardly.

We claim:

1. In a crane:

a telescopic boom;

a jib storable alongside said boom with the jib base end adjacent the boom head;

jib storage means on said boom and on said jib to facilitate storing and installing said jib on said boom;

and pinning means for connecting said jib to said boom head so that said jib can be moved axially between stored and unstored positions alongside said boom, swung horizontally between said unstored position and an installed position in axial alignment with said boom, and secured in said installed position, said pinning means including pin-receiving members on said boom head, manually movable self-storing releasable pins on said jib base end, and a crank-engaging member for moving said pins, one of said pins having a bore therethrough for receiving a crank which is engageable with said crank-engaging member.

2. A crane according to claim 1 wherein said jib storage means comprises:

a forward jib storage assembly and a rear jib storage assembly, each storage assembly including at least one storage pin and at least one pin-receiving lug, each storage pin being engagable with an associated pin-receiving lug in its storage assembly when said jib is in said stored position and disengaged therefrom when said jib is axially moved to said unstored position.

3. A crane according to claim 2 wherein said storage pin and pin-receiving lug of said forward jib storage assembly are mounted on said boom and said jib, respectively, and wherein said storage pin and pin-receiving lug of said rear jib storage assembly are mounted on said jib and said boom respectively.

4. A crane according to claim 3 wherein said rear jib storage assembly includes a ramp mounted on said boom below said pin-receiving lug of said rear jib storage assembly, said ramp cooperating with said jib as the latter moves rearward axially to effect alignment of said storage pin and said pin-receiving lug in said rear jib storage assembly.

5. A crane according to claim 4 wherein said forward jib storage assembly comprises a pair of said storage pins, one located above the other, and a corresponding pair of said pin-receiving lugs.

6. In a crane:

a telescopic boom;

a jib storable alongside said boom with the jib base end adjacent the boom head;

jib storage means on said boom and on said jib to facilitate storing and installing said jib on said boom;

and pinning means on said boom head and on said jib base end for connecting said jib to said boom head so that said jib can be moved axially between stored and unstored positions alongside said boom, swung horizontally between said unstored position and an installed position in axial alignment with said boom, and secured in said installed position;

said pinning means comprising:

a pair of vertically spaced apart pin-receiving members on each lateral side of said boom head, each pin-receiving member having a pin-receiving hole therein;

and a pin assembly on each lateral side of said jib base end, each pin assembly comprising a rotatable tubular housing;

a pin in each end of said housing and in threaded engagement therewith, each pin being axially movable when said tubular housing is rotated;

a crank-engaging member secured within and to said housing between the pins in said housing;

and a bore through one of said pins for receiving a crank which is engageable with said crank-engaging member to effect rotation of said housing.

7. A crane according to claim 6 including locking means on said housing for releasable engagement with a portion of said jib to prevent rotation of said housing.

8. A crane according to claim 6 wherein each pin comprises an externally threaded portion and wherein said housing comprises an internally threaded portion near an end thereof for engagement with said externally threaded portion of said pin.

9. A crane according to claim 8 wherein said pin is provided with an axially extending groove on the periphery thereof and further including a set-screw fixed relative to said jib and extending into said groove to prevent rotation of said pin about its axis as said housing rotates.

10. A crane according to claim 9 wherein said crank-engaging member comprises a rigid element secured to said housing, said element having a hole therethrough for engagement with a crank.

11. In a crane;

a telescopic boom;

a jib storable alongside said boom with the jib base end adjacent the boom head;

jib storage means on said boom and on said jib to facilitate storing and installing said jib on said boom;

and pinning means on said boom head and on said jib base end for connecting said jib to said boom head so that said jib can be moved axially between stored and unstored positions alongside said boom, swung horizontally between said unstored position and an installed position in axial alignment with said boom, and secured in said installed position;

said jib storage means comprising:

a forward jib storage assembly and a rear jib storage assembly, each storage assembly including at least one storage pin and at least one pin-receiving lug, each storage pin being engagable with an associated pin-receiving lug in its storage assembly when said jib is in said stored position and disengaged therefrom when said jib is axially moved to said unstored position;

said rear jib storage assembly including a ramp mounted on said boom below said pin-receiving lug of said rear jib storage assembly, said ramp cooperating with said jib as the latter moves rearward axially to effect alignment of said storage pin and said pin-receiving lug in said rear jib storage assembly prior to said pin entering said pin-receiving lug.

12. A crane according to claim 11 wherein said storage pin and pin-receiving lug of said forward jib storage assembly are mounted on said boom and said jib, respectively, and wherein said storage pin and pin-receiving lug of said rear jib storage assembly are mounted on said jib and said boom respectively.

13. A crane according to claim 12 wherein said forward jib storage assembly comprises a pair of said storage pins, are located above the other, and a corresponding pair of said pin-receiving lugs.

14. In a crane:

a telescopic boom;

a jib storable alongside said boom with the jib base end adjacent the boom head;

jib storage means on said boom and on said jib to facilitate storing and installing said jib on said boom;

and pinning means on said boom head and on said jib base end for connecting said jib to said boom head so that said jib can be moved axially between stored and unstored positions alongside said boom, swung horizontally between said unstored position and an installed position in axial alignment with said boom, and secured in said installed position;

said jib storage means comprises:

a forward jib storage assembly and a rear jib storage assembly, each storage assembly including at least one storage pin and at least one pin-receiving lug, each storage pin being engagable with an associated pin-receiving lug in its storage assembly when said jib is in said stored position and disengaged therefrom when said jib is axially moved to said unstored position;

said pinning means comprising:

a pair of vertically spaced apart pin-receiving members on each lateral side of said boom head, each pin-receiving member having a pin-receiving hole therein;

and a pin assembly on each lateral side of said jib base end, each pin assembly comprising a rotatable tubular housing;

a pin in each end of said housing and in threaded engagement therewith, each pin being axially movable when said tubular housing is rotated;

a crank-engaging member secured within and to said housing between the pins in said housing;

a bore through one of said pins for receiving a crank which is engagable with said crank-engaging member to effect rotation of said housing;

and locking means on said housing for releasable engagement with a portion of said jib to prevent rotation of said housing.

15. A crane according to claim 14 wherein said storage pin and pin-receiving lug of said forward jib storage assembly are mounted on said boom and said jib, respectively;

wherein said storage pin and pin-receiving lug of said rear jib storage assembly are mounted on said jib and said boom respectively;

and wherein said rear jib storage assembly includes a ramp mounted on said boom below said pin-receiving lug of said rear jib storage assembly, said ramp cooperating with said jib as the latter moves rearward axially to effect alignment of said storage pin and said pin-receiving lug in said rear jib storage assembly.

16. A crane according to claim 15 wherein said forward jib storage assembly comprises a pair of said storage pins, one located above the other, and a corresponding pair of said pin-receiving lugs.

17. A crane according to claim 15 wherein each pin comprises an externally threaded portion;

wherein said housing comprises an internally threaded portion near an end thereof for engagement with said externally threaded portion of said pin;

and wherein said pin is provided with an axially extending groove on the periphery thereof and further including a set-screw fixed relative to said jib and extending into said groove to prevent rotation of said pin about its axis as said housing rotates.

18. A crane according to claim 17 wherein said crank-engaging member comprises a rigid element secured to said housing, said element having a hole therethrough for engagement with a crank.

* * * * *